United States Patent [19]

Sconzo

[11] 4,187,643

[45] Feb. 12, 1980

[54] WINDOW AND DOOR FRAME ASSEMBLY ADAPTED TO FACILITATE INSTALLATION AND REMOVAL OF WINDOW PANES

[76] Inventor: Thomas Sconzo, 141 Macon St., Sayville, N.Y. 11782

[21] Appl. No.: 961,677

[22] Filed: Nov. 17, 1978

[51] Int. Cl.[2] ..... E05D 15/06

[52] U.S. Cl. ..... 49/455; 49/195

[58] Field of Search ..... 49/436, 453–456, 49/459, 194, 195

[56] References Cited

U.S. PATENT DOCUMENTS

| | | | |
|---|---|---|---|
| 2,570,986 | 10/1951 | Riley | 49/455 X |
| 2,818,609 | 1/1958 | Nielson | 49/455 X |
| 3,023,465 | 3/1962 | Sconzo | 49/436 |

FOREIGN PATENT DOCUMENTS

| | | | |
|---|---|---|---|
| 1434974 | 7/1963 | Fed. Rep. of Germany | 49/453 |
| 328074 | 4/1930 | United Kingdom | 49/455 |

*Primary Examiner*—Kenneth Downey

*Attorney, Agent, or Firm*—Edward H. Loveman

[57] ABSTRACT

A rectangular window frame defined by four frame members, has two spline members supported by a pair of laterally spaced frame members. The spline members are formed with blade portions arranged to retain a sash in the window frame. One on both of the spline members are longitudinally slidable in a tubular frame portion against a spring bias and each is normally retained at one end in a socket formed in an adjacent frame member. The spring bias is provided by a coil spring in the tubular frame portion bearing against the other end of the spline member. When the spline member is disengaged from the pocket it is rotatable out of the way to permit the sash to be installed in or removed from the window frame. The blade portion of each longitudinally slidable spline member may be formed with an aperture or slot to receive a tool for longitudinally sliding the spline member to disengage it from the retaining socket. Alternatively a protuberance such as a knob may be provided on the spline member to move it longitudinally and disengage it from the retaining socket.

10 Claims, 10 Drawing Figures

WINDOW AND DOOR FRAME ASSEMBLY ADAPTED TO FACILITATE INSTALLATION AND REMOVAL OF WINDOW PANES

This invention relates to storm windows and storm doors and more particularly relates to a novel means enabling ready installation and removal of the windows in storm windows and storm doors.

In my prior U.S. Pat. No. 3,023,465, I described a window frame assembly in which splines having cylindrical edges are rotatably engaged in cylindrical cavities in the window frame. The splines carry felt strips which serve as low friction raceways and windproof seals for sashes installed in the window frame. The splines are rotatable to permit the sashes to be removed from the window frame. The sashes are held in the window frame by conical members retractably engaged on serrated ramps formed inside the window frame.

The present invention is directed at improvements in the prior window frame assembly, wherein the retractable conical members and serrated ramps are omitted. The window frame is modified so that at least one rotatable spline retaining each window sash is normally held in place under spring tension and prevented from rotation by engagement in a socket formed inside the window frame. The spring loaded spline may be moved axially against spring bias to release it from the socket, whereupon the spline may be rotated to release the retained sash from the window frame.

It is, therefore, a principal object of the present invention to provide a simplified means for removably retaining a sash in a window frame.

Another object of the present invention is to provide an extruded metal window frame with rotatable splines for retaining a sash, each spline having a coil spring for holding the spline engaged in a socket formed in the window frame, to prevent the spline from rotating.

A further object of the present invention is to provide a window frame with rotatable splines as described, with aperture means enabling the splines to be moved lengthwise against spring bias to release the splines from the retaining sockets in the window frame, and enabling the splines to be rotated freely for releasing the sashes from the window frame.

These and other objects and many of the attendant advantages of this invention will be readily appreciated as the same becomes better understood by reference to the following detailed description when considered in connection with the accompanying drawings in which.

Figure 1:
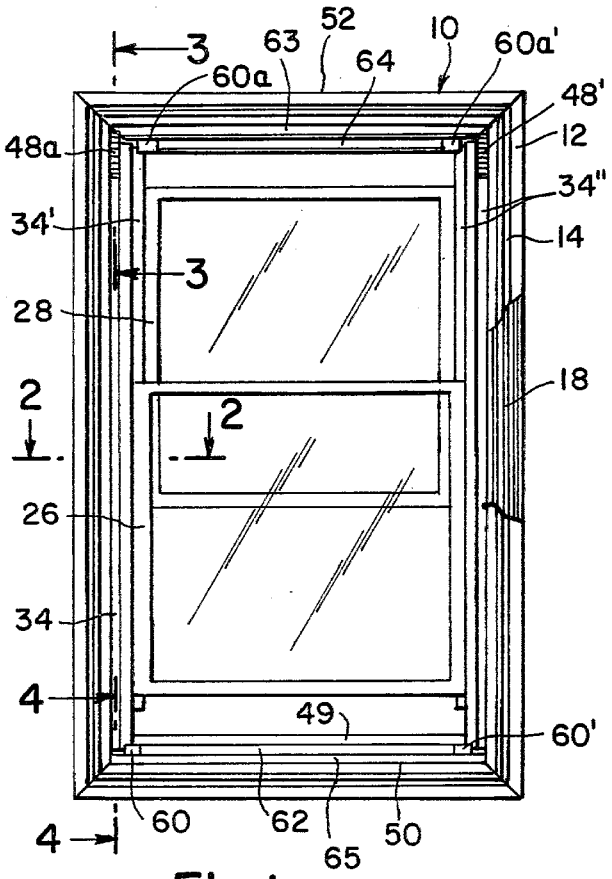
FIG. 1 is a rear elevational view of a storm window assembly embodying the present invention.
Figure 2:
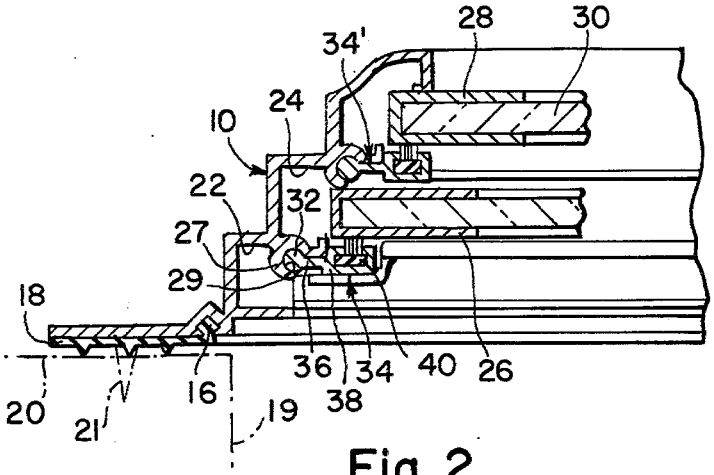
FIG. 2 is an enlarged horizontal fragmentary cross sectional view taken along line 2—2 of FIG. 1.

Referring now to the drawings wherein like reference characters designate like or corresponding parts throughout, there is illustrated in FIGS. 1 and 2, a vertically disposed rectangular storm window frame generally designated as reference numeral 10 having a flat peripheral flange 12 formed with a groove 14 in its rear face. The groove 14 receives a ridge 16 of a gasket 18 which seals the frame 10 around an opening 19 of a window or door frame 20, shown in dotted lines in FIG. 2. The gasket 18 is shown partially broken away in FIG. 1. The frame 10 is secured by a plurality of screws 21 to the frame 20 and extends forwardly therefrom.

The frame 10 may be formed of an extruded metal such as aluminum, and has a plurality of side channels 22, 24 integrally formed therein to receive rectangular sashes 26, 28 in which are set glass panes 30. The channels 22, 24 are each formed with a tubular channel section 27 having a cylindrical cavity 29 and a lateral slot 31; see FIG. 5. Rotatably disposed in the tubular channel section 27 is a cylindrical bead 32 of a spline member 34 or 34'. The spline member 34 or 34' has a flat blade portion 36 integral with the bead 32 and extending through the slot 31; see FIGS. 2, 5, 6, 7. Integral with the blade 36 is a box-like channel portion 38 in which is inserted a resilient plastic strip 40 having a felt face 42 for abutting the rear side of the rectangular sash 26 or 28. The spline member 34 or 34' is rotatably engaged in the channel section 27 and is also longitudinally slidable therein.

Figure 6:
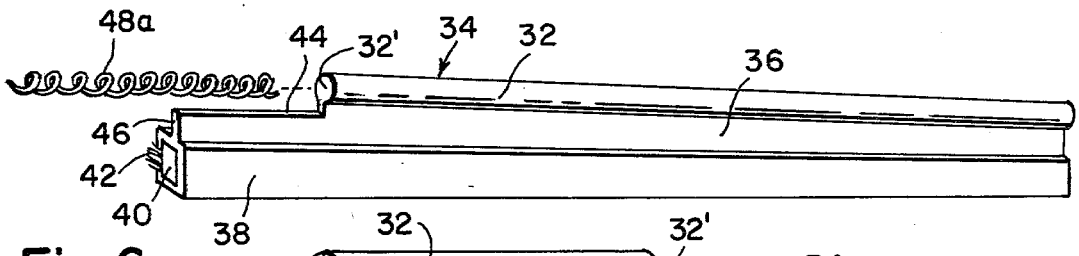
FIG. 6 is an enlarged rear and end perspective view of the spline member shown with an associated coil spring.
Figure 7:
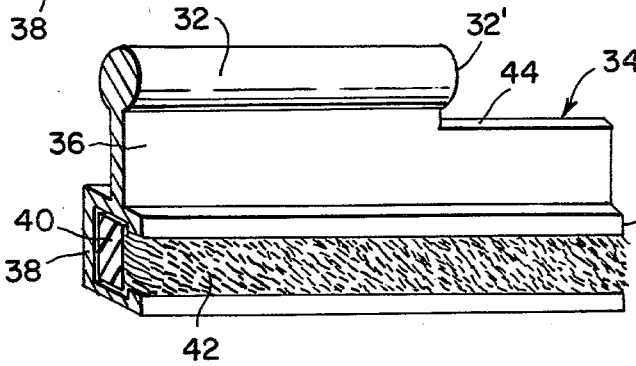
FIG. 7 is a further enlarged front and end perspective view of the spline member of FIG. 6.

One corner 44 of each spline member 34 or 34' is cut out as best shown in FIGS. 6 and 7, so that the cylindrical bead 32 terminates short of one end 46 of the spline member 34 or 34'. A coil spring **48*a* having a diameter equal to that of the bead 32 is inserted in the cavity 29 of the tubular channel section 27, see FIG. 3. There the spring 48*a* is compressed and its end bears against an end 32' of the bead 32. The spline members 34 and 34' in rear and front channels 22 and 24 respectively are oppositely disposed so that a spring 48*b* is at the lower end of the front spline member 34' while the spring 48*a* is located at the upper end of the rear spline member 34**; see FIGS. 3 and 4.

Figure 3:
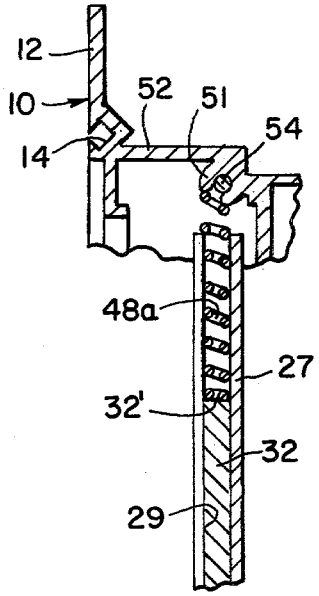

The lower spring **48*b* bears against a rail 49 formed on an extruded bottom section 50 of the frame 10. The upper spring 48*a* bears against a tubular frame portion 51 formed in an upper extruded section 52 of the frame 10. A screw 54 shown in FIG. 3 is seated in the tubular frame portion 51 and holds the mitered vertical and horizontal frame sections together. Similar screws (not shown) are located at the four corners of the frame 10** to hold the window frame assembly together.

Figure 4:
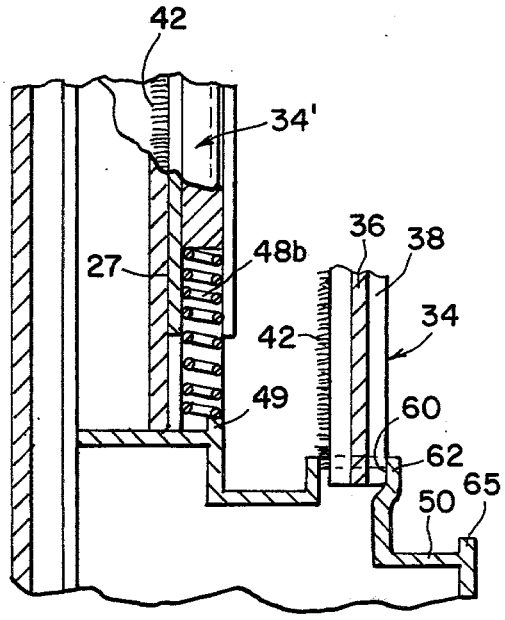
FIG. 3 and FIG. 4 are enlarged vertical fragmentary sectional views taken along lines 3—3 and 4—4 respectively of FIG. 1.

The lower end of the rear spline member 34 is engaged in a pocket 60 formed by bending and distorting the metal wall of a rail 62 in the bottom section 50 of the frame 10; see FIG. 4. The upper end of the front spline member 34' is engaged in a similar pocket **60*a* formed by bending and distorting the metal wall of a rail 64 in the upper section 52 of the frame 10; see FIG. 1. A similar arrangement of spring loaded spline members 34'', springs 48' and pockets 60', 60*a'* can be provided at the other side of the window frame 10. However, in general, only one spring loaded spline member 34 or, 34'** need be provided for each sash. The other spline members 34″ can be secured non-rotatably in the window frame.

Figure 5:
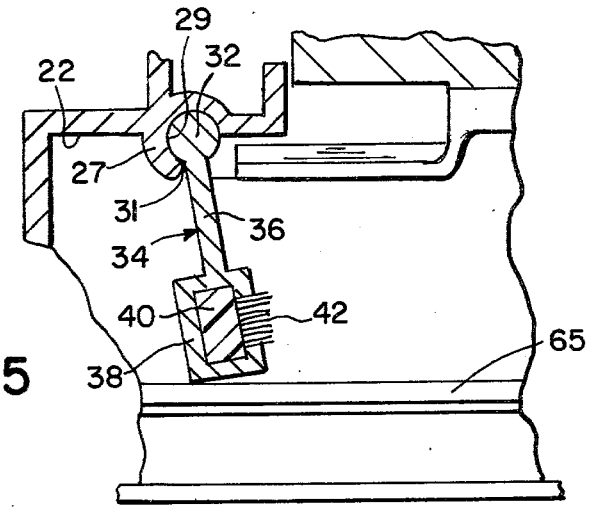
FIG. 5 is a further enlarged fragmentary sectional view of a portion of FIG. 2 showing a spline member in rotated position for releasing a sash in the window frame.

To remove or install a sash, such as sash 26 the longitudinally movable spline 34 is grasped and moved lengthwise further compressing the retaining spring 48*a* to disengage the spline end engaged in the rail pockets 60. This will permit the spline member 34 to be rotated freely rearwardly about 90° as illustrated in FIG. 5 to abut lower rail 65. The way is now clear to remove the retained sash 26 by pushing the sash rearwardly or to reinstall it by pushing the sash forwardly. The spline member which is moved longitudinally and turned rearwardly is easily accessible when double hung sashes are used as shown in FIG. 1.

Figure 8:
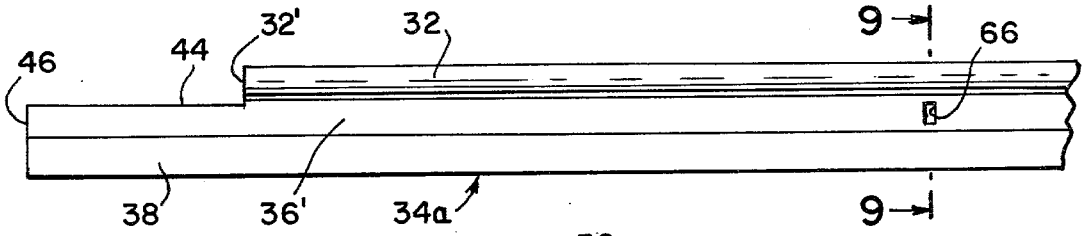
FIG. 8 is a rear elevational view of part of another spline member.
Figure 9:
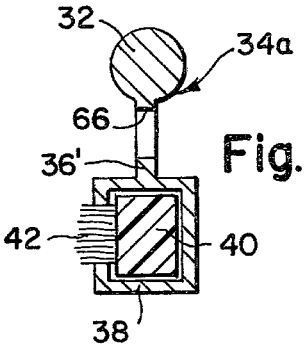
FIG. 9 is an enlarged cross sectional view taken along line 9—9 of FIG. 8.

If a single full length sash is installed in frame 10, the means shown in FIGS. 8 and 9 may be used to engage and move the single sash longitudinally and to turn it rearwardly. A spline member 34*a* which can be used for a full length sash, is provided with a slot or aperture 66 formed in a flat bladelike wall 36′. A screw driver or other tool can be inserted in this aperture to enable the spline member 34*a* to be moved longitudinally and then turned rearwardly when the spline member is disengaged from the retaining rail pocket.

Figure 10:
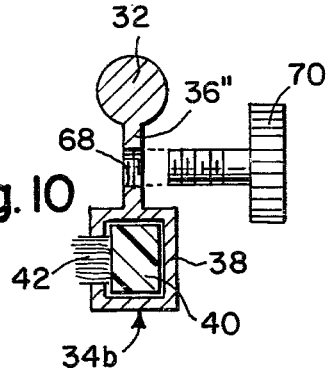
FIG. 10 is a sectional view similar to FIG. 9 showing another spline member with associated bolt or knob.

In FIG. 10 is shown another spline member 34*b* in which a threaded hole 68 is formed in a wall 36″ of the spline member 34*b*. A threaded bolt or knob 70 can be engaged in the threaded hole 68 to protrude therefrom. This protuberance will serve as a hand or finger grip for moving the spline member 34*b* longitudinally to release the spline member 34*b* from the retaining rail pocket and to enable the spline member to be turned rearwardly.

It will be noted that the spline members are provided at the vertical sides of frame 10 in an installation where the sashes move vertically. In a frame where the sashes move horizontally, the spline members will be provided at the top and bottom of frame 10. This can be visualized by turning FIG. 1 90° so the vertical frame sections are horizontal and the horizontal frame sections are vertical. If only a single stationary full length sash is provided in a frame for a storm window or storm door, it is preferable that the spline members be located at the longer sides of the frame to facilitate installation and removal of the sash.

It should be understood that the foregoing relates to only a limited number of preferred embodiments of the invention which have been by way of example only and that it is intended to cover all changes and modifications of the examples of the invention herein chosen for the purposes of the disclosure, which do not constitute departures from the spirit and scope of the invention.

What is claimed is:

1. A window frame assembly, comprising:

a pair of side frame members;

a pair of end frame members joined to ends of said side frame members to define a rectangular frame for supporting at least one sash;

a tubular channel integrally formed with one frame member of one of said pairs of frame members, and extending for substantially the length of said frame member, said channel having a lateral slot therein;

a spline member having a cylindrical bead rotatably and slidably engaged in said channel, and having a blade portion extending through said slot and for the length of said channel for retaining said sash in said window frame;

spring means in said channel bearing against one end of said spline member urging the same lengthwise along said channel; and a pocket formed in a member of the other pair of frame members adjacent said one frame member and having a configuration which prevents rotation of said spline member when the other end of said spline member is seated in said pocket and for releasing said other end of said spline member, whereby said spline member can be moved longitudinally against the bias of said spring means to release said spline member, so that said sash can be readily installed and removed.

2. A window frame assembly as defined in claim 1, further comprising another spline member disposed at the other frame member of said one pair of frame members and arranged to cooperate with the first named spline member to retain said sash in said window frame.

3. A window frame assembly as defined in claim 1, further comprising means on said spline member for engaging the same to move said spline member longitudinally to release the same from said pocket and enable rotation of said spline member.

4. A window frame assembly as defined in claim 3, wherein said last named means is an aperture in said blade portion of said spline member.

5. A window frame assembly as defined in claim 3, wherein said last named means is a protuberance which can be grasped for moving said spline member longitudinally and for rotating said spline member when released from said pocket.

6. A window frame assembly as defined in claim 1, further comprising another tubular channel integrally formed with another frame member of said one pair of frame members and extending for substantially the length of said other frame member, said other channel having a lateral other slot therein;

another spline member having another cylindrical bead rotatably and slidably engaged in said other channel, and having another blade portion extending through said other slot and for the length of said other channel for retaining said sash in said window frame;

other spring means in said other channel bearing against one end of said other spline member urging the same lengthwise along said other channel; and another pocket formed in one frame member of said other pair of frame members and having a configuration which prevents rotation of said other spline member when the other end of said other spline member is seated in said other pocket and for releasing said other end of said other spline member, whereby said other spline member can be moved longitudinally against the bias of said other spring means to permit rotation of said other spline member so that said sash can be readily installed and removed.

7. A window frame assembly as defined in claim 6, further comprising means on each of said spline members for engaging and moving the same longitudinally against the spring bias to release said spline members from said pockets and for rotating said spline members to clear a way for installation and removal of said sash.

8. A window frame assembly as defined in claim 7, wherein the last named means is an aperture in the blade portion of each spline member.

9. A window frame assembly as defined in claim 8, wherein the last named means is a protuberance on each spline member which can be grasped for moving said spline members longitudinally against the spring bias to release said spline members from said pockets and for rotating said spline members when released from said pockets.

10. A window frame assembly as defined in claim 8, wherein said sash is shorter then said one pair of frame members so that said sash is slidably retained by said spline members in said window frame.

* * * * *